US005863711A

United States Patent [19]

Zahn et al.

[11] Patent Number: 5,863,711

[45] Date of Patent: Jan. 26, 1999

[54] PROCESS FOR THE PRODUCTION OF IMAGES ON PAPER

[75] Inventors: Wolfgang Zahn, München; Werner Ritter Von Stein, Hamburg, both of Germany

[73] Assignee: Agfa Gevaert AG, Germany

[21] Appl. No.: 906,384

[22] Filed: Aug. 5, 1997

[30] Foreign Application Priority Data

Aug. 12, 1996 [DE] Germany ..... 196 32 429.7

[51] Int. Cl.[6] ..... G03C 7/407

[52] U.S. Cl. ..... 430/359; 430/362; 430/423

[58] Field of Search ..... 355/77, 132; 430/423, 430/359, 362

[56] References Cited

U.S. PATENT DOCUMENTS 4,362,383 12/1982 Yonehara et al. ..... 355/77
5,081,486 1/1992 von Stein et al. ..... 355/77

*Primary Examiner*—Hoa Van Le
*Attorney, Agent, or Firm*—Connolly & Hutz

[57] ABSTRACT

In a process for the production of colour photographic prints, in which transparent colour photographic originals having a wide range of brightness are reproduced on a colour photographic paper and the colour photographic paper exposed in this manner is subjected to a process comprising at least the stages colour development and silver removal, satisfactory definition both in the highlights and in the shadows is achieved by locally modifying the sensitivity of the colour negative paper before processing as a function of the original and with the modification not being sharply defined.

7 Claims, 2 Drawing Sheets

PROCESS FOR THE PRODUCTION OF IMAGES ON PAPER

BACKGROUND OF THE INVENTION

This invention relates to a process for the production of colour photographic prints (print images, hand copies), in which transparent colour photographic originals, for example colour negatives, are reproduced on a colour photographic paper and the colour photographic paper exposed in this manner is subjected to processing which comprises at least the stages colour development and silver removal.

SUMMARY OF THE INVENTION

Colour negative films are conventionally prepared with a wide exposure range so that good prints may still be produced if the photograph is slightly under- or overexposed (conventionally by up to two stops in each case). If the curves for the three colours are plotted on a graph with colour density D as the y-coordinate and exposure H as the x-coordinate, the lines obtained have a slight gradient in the so-called characteristic range (flat gradation). Thanks to the flat gradation, it is possible correctly to reproduce scenes having a wide range of brightness because the colour negative film has sufficient density gradation.

In order to produce prints having satisfactory contrast, colour photographic paper is made with a steep gradation and thus with a narrower exposure range than the colour negative film. In scenes having a wide range of brightness, this results in unsatisfactory results because either the highlights or the shadows are no longer differentiated although they are still well defined on the film. One example which may be mentioned is a photograph of a church interior, in which the colour negative film reproduces all the details of the relatively dark interior and of the bright windows, but after printing on colour negative paper, either the bright window or the dark interior remain undifferentiated.

Many proposals have already been made to improve this situation, wherein the proposals are based either on a fundamental modification of the colour negative paper or on a change during exposure of the print:

EP 304 297, EP 368 271, U.S. Pat. No. 4,806,460 (addition of a green-sensitiser to the red-sensitive layer), U.S. Pat. No. 5,266,451 (addition of a sensitiser in an interlayer), U.S. Pat. No. 5,445,928, U.S. Pat. No. 5,437,969 (use of a so-called gap sensitiser), U.S. Pat. No. 5,084,374 (addition of a blue-sensitiser to the red-sensitive layer), EP 356 077 (addition of a colour coupler to the interlayer), JP 55/059 462 (use of a black coupler), DE 44 23 129 (colour negative paper having variable gradation), EP 627 655 (contrast correction by additional exposure), DE 42 36 568 (individually calculated masks), DE 28 20 965 (LCD matrix between the exposure system and the original).

A disadvantage common to any modification of the structure of the colour negative paper is that it entails additional cost, so making the product more expensive, although the modification is exploited in only a very small proportion of photographs.

The same applies to additional equipment attached to the printer in order to modify printing exposure.

The object of the invention was to produce a print on colour negative paper in a simple manner starting from an original, for example a colour negative having a wide range of brightness, the print being well defined in both the highlights and the shadows.

This object is achieved by locally modifying the sensitivity of the colour negative paper before processing as a function of the original and with the modification not being sharply defined.

This requires an analyser, which analyses the original, for example a colour negative, by measuring the red, green and blue densities at various points on the image, a control unit, which derives control signals from the measured colour densities to bring about the local modification of the sensitivity of the colour negative paper and a means which locally modifies the sensitivity of the colour negative paper.

The local modification of sensitivity preferably proceeds after recording the control signals through the colour negative and before processing the colour paper. The local modification of sensitivity may proceed, for example, before or after exposure and before or during processing.

The sensitivity of the colour negative paper is locally modified in such a manner that those areas of the colour negative paper corresponding to the light areas of the negative are made less sensitive or those areas of the colour negative paper corresponding to the dark areas of the negative are made more sensitive. Both measures may be combined.

The overall gradation and thus the characteristic nature of the paper remains unchanged; a paper having a steep gradation remains steep, a paper having flat gradation remains flat. The intention is to modify only those parts of the subject which appear over- or under-exposed in the paper image. If the density on the film is too high (the highlights on the paper) or too low (the shadows on the paper), the methods described below should be used to make the colour negative paper respectively more or less sensitive in the area of affected parts of the image than the unaffected parts of the image.

Depending upon the process, the local modification of sensitivity may be performed before, during or after image exposure.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

The following practical examples are performed using technically straightforward processes. In one case, the partial pre-exposure process is used (described as "sub-threshold additional exposure"), in which specific points of the paper are diffusely pre-exposed in the colours blue, green and red by means of a fibre optic CRT. The intensification process is used in Example 3, which is performed by local spraying of a hydrogen peroxide solution by means of an inkjet device.

Using other approaches, the processes may also be performed by means of an inkjet printer by using special inks. An infra-red (IR) fibre optic CRT could be considered for the process according to claims 3 and 4 (inhibitors, activators).

Figure 1:
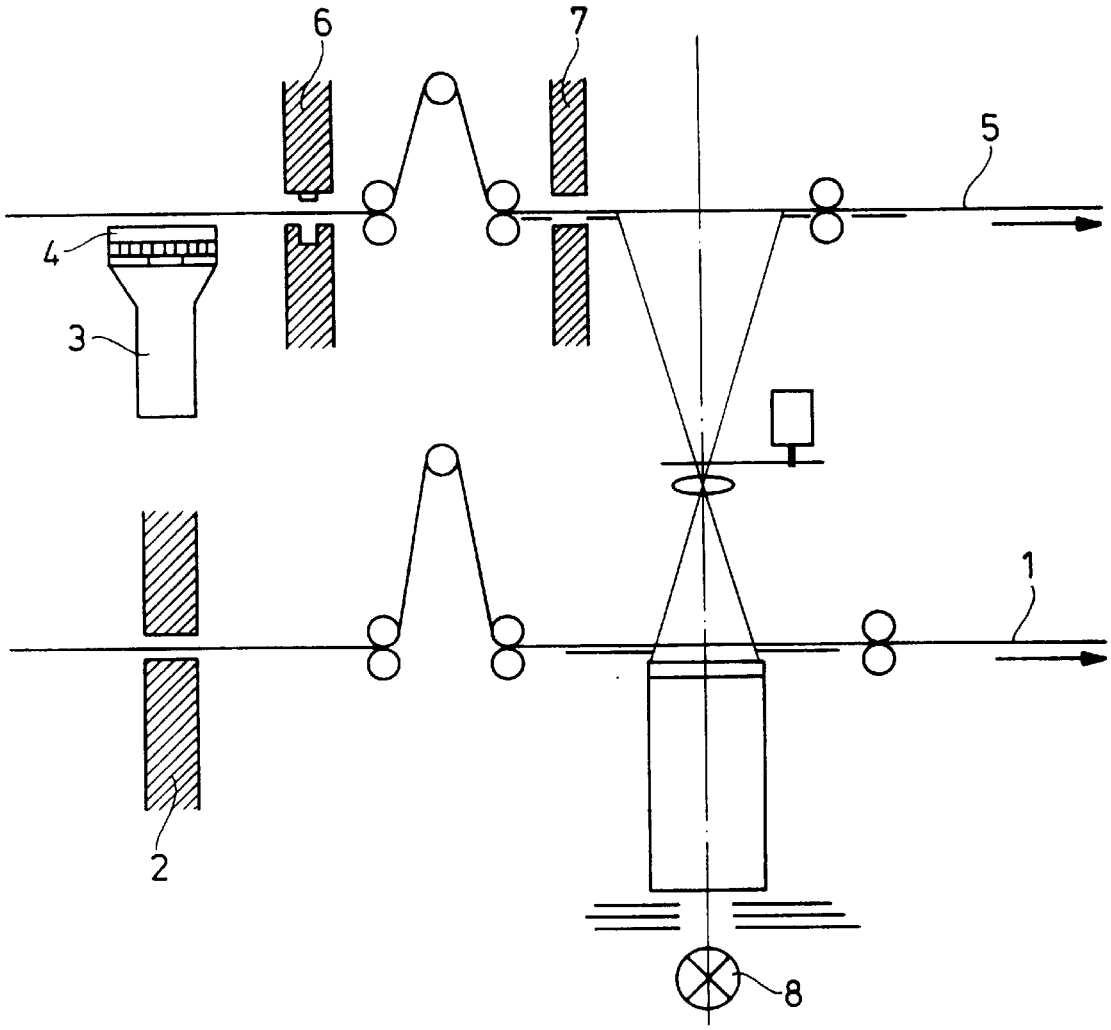
FIGS. 1 and 2 are diagrammatic views each showing the principle of an apparatus with which the process according to the invention may be performed.

FIG. 1 shows the film 1, which has been exposed and developed and is being conveyed in the direction of the arrow. It passes a colour scanner 2, by means of which information is obtained from the film, computed and transmitted to the colour fibre optic CRT 3. The colour paper 5 is pre-exposed through a matt screen 4, and, after the fibre optic CRT 3, passes through the hole punch 6 and the hole sensor 7 in order to be in exact register with the colour film for the actual exposure by the standard lamp housing 8. The colour paper is also conveyed in the direction of the arrow.

Figure 2:
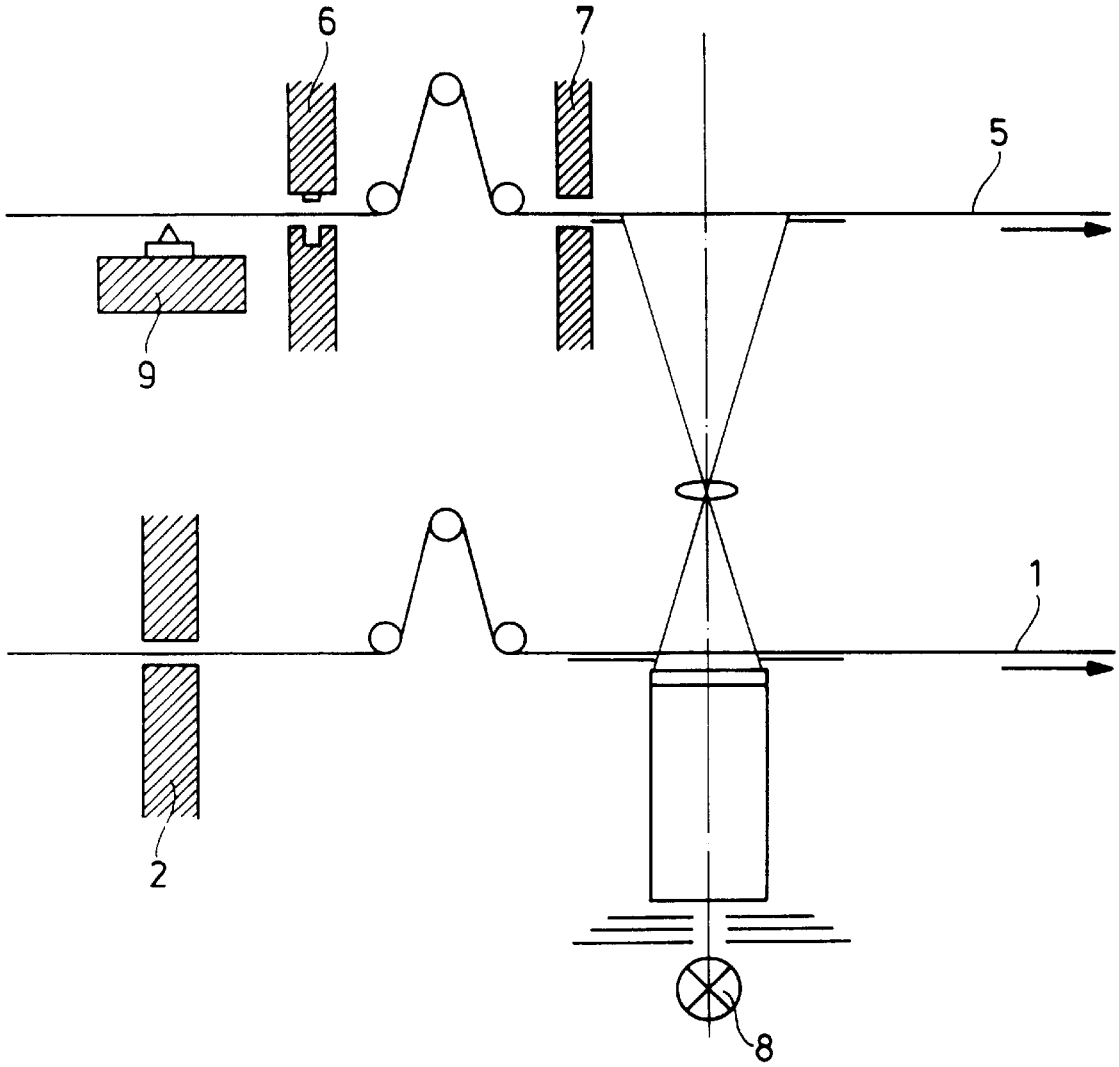

FIG. 2 differs from FIG. 1 only by the fact that the colour scanner 2 controls not a fibre optic CRT, but instead an inkjet printer 9.

EXAMPLE 1

(Comparison)

The following photographic materials are used in the tests described below:

Film: Agfacolor Ultra 50,

Paper: Agfacolor Professional Signum Paper.

The photographic materials are processed using the AP 70 process for the film, the AP 94 process for the paper.

The film is exposed with the following scenes:

scene 1: dark room with pictures on the wall and furniture in front of a bright window.

scene 2: dark doorway with several people, bright foreground.

A bracketed series of exposures from −2 to +2 stops was made of each subject.

The images are exposed with a conventional commercial printer.

The samples are characterised in the following manner:

1st figure: no. of Example,

2nd figure: 1=scene 1; 2=scene 2,

3rd figure: 1=underexposure by 2 stops; 2=overexposure by 2 stops.

The results are shown in Table 1.

EXAMPLE 2

(Invention)

Materials and processing as in Example 1.

The following steps are performed on exposure of the colour negative paper:

The colour negative paper is exposed with an apparatus as shown in FIG. 1.

Information about the exposed negatives is obtained in the "colour scanner" sensor unit. The data necessary for contrast reduction for the pre-exposure are calculated and, with a time delay, the paper is neutrally pre-exposed with a colour fibre optic CRT. The pre-exposure is diffuse. Those areas on the print corresponding to the dark areas on the negative are selectively pre-exposed.

The paper is positioned in the actual print unit by means of previously punched holes and exposed in register.

This Example demonstrates that a distinct improvement in the image quality of critical subjects may be achieved by the treatment according to the invention.

EXAMPLE 3

(Invention)

Materials and processing as in Example 1.

The following steps are performed on exposure of the colour negative paper:

The colour negative paper is exposed with an apparatus as shown in FIG. 2. Information about the exposed negatives is obtained in the "colour scanner" sensor unit. The data necessary for contrast reduction are calculated and converted into control signals for an inkjet printer, which, in the dark areas of the negative, applies a 0.5 wt. % hydrogen peroxide solution onto the corresponding highlights of the paper image, such that there is a smooth transition with adjacent areas.

The paper is exposed in register in the downstream print unit. The results are shown in Table 1.

This Example demonstrates that a distinct improvement in the image quality of critical subjects may be achieved by the treatment according to the invention.

TABLE 1

| Sample | Definition of high-lights in print | Definition of shadows in print | Status |
|---|---|---|---|
| 111 | 2 | 3 | Comparison |
| 112 | 3 | 2 | " |
| 121 | 3 | 3 | " |
| 122 | 3 | 3 | " |
| 211 | 1 | 1 | Invention |
| 212 | 1 | 1 | " |
| 221 | 1 | 1 | " |
| 222 | 2 | 1 | " |
| 311 | 1 | 1 | Invention |
| 312 | 1 | 1 | " |
| 321 | 1 | 1 | " |
| 322 | 1 | 1 | " |

Rating: 3: poor; 2: acceptable; 1: good.

We claim:

1. Process for the production of a colour photographic pint in which a transparent colour photographic original is reproduced on a colour photographic paper, comprising the steps of subjecting the colour photographic paper exposed in this manner to at least the stages of colour development and silver removal by modifying the sensitivity of predetermined portions of the colour photographic paper before processing, determining those portions of the colour photographic paper to be modified based upon a function of the colour photographic original, and modifying the sensitivity of the colour photographic paper in such a manner that the modification is not sharply defined.

2. Process according to claim 1, wherein the sensitivity of the predetermined portions of the colour photographic paper are modified by applying dyes or colour pigments acting as optical filters onto the paper emulsion and the dyes or colour pigments are removed again or decoloured after exposure with the image.

3. Process according to claim 1, wherein the sensitivity of the predetermined portions of the colour photographic paper are modified by local bleaching (reduction in density) or colouring (increased in density) of a layer applied uniformly on the paper, which is entirely removed or decoloured after exposure with the image.

4. Process according to claim 1, wherein the sensitivity of the predetermined portions of the colour photographic paper are modified by local application of chemically acting substances such as inhibitors, activators or intensifiers.

5. Process according to claim 4, characterised in that the chemically acting substances are uniformly introduced in a non-active form and are activated by local application of non-actinic additional exposure, heat or pressure.

6. Process according to claim 1, wherein the sensitivity of the predetermined portions of the colour photographic paper are modified by modification of temperature, an electric or magnetic filed, a subthreshold additional exposure or ultrasonication.

7. Process according to claim 1, characterised in that this process is combined with a process for locally influencing the effective gradation of the paper.

* * * * *

UNITED STATES PATENT AND TRADEMARK OFFICE

CERTIFICATE OF CORRECTION

PATENT NO. : 5,863,711
DATED : January 26,1999
INVENTOR(S) : Wolfgang Zahn, et al.

It is certified that error appears in the above-identified patent and that said Letters Patent is hereby corrected as shown below:

Column 1, line 12, delete "SUMMARY OF THE INVENTION".

Column 1, after line 58, insert -- SUMMARY OF THE INVENTION --.

Column 4, line 27 (claim 1, line 1), "pint" should read -- print --.

Signed and Sealed this

Twenty-fifth Day of May, 1999

*Attest:*

*Attesting Officer*

Q. TODD DICKINSON

*Acting Commissioner of Patents and Trademarks*